US009835964B2

(12) United States Patent
Yoshida et al.

(10) Patent No.: US 9,835,964 B2
(45) **Date of Patent: *Dec. 5, 2017**

(54) TONER

(71) Applicant: CANON KABUSHIKI KAISHA, Tokyo (JP)

(72) Inventors: Yu Yoshida, Mishima (JP); Masatake Tanaka, Yokohama (JP); Yoshihiro Nakagawa, Numazu (JP); Naoya Isono, Suntou-gun (JP); Tsutomu Shimano, Mishima (JP); Shintaro Noji, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 156 days.

This patent is subject to a terminal disclaimer.

(21) Appl. No.: 14/555,530

(22) Filed: Nov. 26, 2014

(65) Prior Publication Data

US 2015/0153669 A1 Jun. 4, 2015

(30) Foreign Application Priority Data

Nov. 29, 2013 (JP) ..... 2013-247690

(51) Int. Cl.
*G03G 9/087* (2006.01)
*G03G 9/08* (2006.01)

(52) U.S. Cl.
CPC ..... *G03G 9/08711* (2013.01); *G03G 9/0804* (2013.01); *G03G 9/08755* (2013.01); *G03G 9/08788* (2013.01); *G03G 9/08795* (2013.01); *G03G 9/08797* (2013.01)

(58) Field of Classification Search
CPC ..... G03G 9/08788; G03G 9/08755; G03G 9/08711; G03G 9/08795
USPC ..... 430/109.4, 109.3
See application file for complete search history.

(56) References Cited

U.S. PATENT DOCUMENTS

| | | | | |
|---|---|---|---|---|
| 5,260,159 | A | 11/1993 | Ohtani et al. | |
| 7,763,409 | B2 * | 7/2010 | Hirota | G03G 9/08797 430/109.1 |
| 7,842,446 | B2 | 11/2010 | Yanase et al. | |
| 9,377,705 | B2 * | 6/2016 | Shimano | G03G 9/08755 |
| 9,383,668 | B2 * | 7/2016 | Noji | G03G 9/0804 |
| 9,599,919 | B2 * | 3/2017 | Isono | G03G 9/0804 |
| 2009/0068578 | A1 | 3/2009 | Murakami et al. | |
| 2014/0302437 | A1 | 10/2014 | Shimano et al. | |

FOREIGN PATENT DOCUMENTS

| | | | |
|---|---|---|---|
| JP | 62-273574 | A | 11/1987 |
| JP | 2006-106727 | A | 4/2006 |
| JP | 2012-128071 | A | 7/2012 |

OTHER PUBLICATIONS

Diamond, A.S., ed., Handbook of Imaging Materials, Marcel Dekker, Inc., NY (1991), pp. 168-169.*
U.S. Appl. No. 14/555,525, filed Nov. 26, 2014. Inventors: Naoya Isono, et al.
U.S. Appl. No. 14/555,536, filed Nov. 26, 2014. Inventors: Tsutomu Shimano, et al.
U.S. Appl. No. 14/554,802, filed Nov. 26, 2014. Inventors: Shintaro Noji, et al.
U.S. Appl. No. 14/554,832, filed Nov. 26, 2014. Inventors: Masatake Tanaka, et al.

* cited by examiner

*Primary Examiner* — Janis L Dote
(74) *Attorney, Agent, or Firm* — Fitzpatrick Cella Harper and Scinto

(57) ABSTRACT

The present invention provides a toner that exhibits an excellent colorant dispersibility and hence maintains the formation of a high-quality image, that is capable of low-temperature fixing, and that has a satisfactory heat-resistant storability and a satisfactory durability, in which the toner comprising a toner particle that contains a colorant and a binder resin containing a styrene-acrylic resin and a crystalline resin, wherein a compatibility parameter (V) between the styrene-acrylic resin and the crystalline resin satisfies $0.40 \leq V \leq 1.10$.

12 Claims, 2 Drawing Sheets

TONER

BACKGROUND OF THE INVENTION

Field of the Invention

The present invention relates to a toner that is used in image-forming methods such as electrophotographic methods, electrostatic recording methods, and toner jet methods.

Description of the Related Art

There has been demand in recent years for lower energy consumption in, for example, copiers and printers. An effective means for doing this is to reduce the set temperature in the fixing member. However, this then requires, as a property of the toner, that softening occurs at lower temperatures. In addition, copiers and printers are now being used in diverse regions and environments, and it is therefore necessary to also provide storability at high temperatures (heat-resistant storability). The use of crystalline materials has been investigated for these problems.

A property of crystalline materials is that they exhibit almost no change in viscosity up to the melting point and then melt all at once when the melting point is exceeded (a sharp melt property). By introducing a crystalline material into a toner, the glass transition temperature (Tg) of the binder is lowered by heating during fixing, without causing a deterioration in the heat-resistant storability, and the fixing performance (low-temperature fixability) can be improved at a low set temperature.

Japanese Patent Application Laid-open No. 2006-106727 provides a toner that uses a crystalline material. However, when a toner as taught here undergoes melting during fixing, the binder resin and the crystalline material may end up separating, and the pigment dispersibility in the fixed image then declines and the appearance quality of the image undergoes a decline. For the same reason, the effect of reducing the glass transition temperature (Tg) of the binder resin during fixing may also not be satisfactory.

To respond to this problem, Japanese Patent Application Laid-open No. 2012-128071 proposes a composite resin of a crystalline material and an amorphous material. Here, an amorphous segment is introduced through graft polymerization into a crystalline material. However, from the standpoint of the production method, when the introduction of a large amount of the amorphous component is sought, adverse effects occur such as an increase in the molecular weight due to crosslinking reactions, and as a consequence the problem at issue is not solved.

Also in view of this problem, Japanese Patent Application Laid-open No. S62-273574 proposes the use of a crystalline block resin and amorphous block resin as the binder resin. However, when such a toner is used, since the principle binder resin is the block resin, the block resin that is the crystalline material is present at the toner surface. Since a property of crystalline materials is that they are brittle with respect to external forces, when continuous high-speed printing is performed a satisfactory durability is not obtained, as compared with the highly durable styrene-acrylic binder resins, and this becomes a factor in causing image defects such as, for example, development stripes.

SUMMARY OF THE INVENTION

The present invention provides a toner that solves the problems heretofore encountered as described above. Thus, the present invention provides a toner that exhibits an excellent colorant dispersibility and hence maintains the formation of a high-quality image, that is capable of low-temperature fixing, and that has a satisfactory heat-resistant storability and a satisfactory durability.

The invention according to this application relates to a toner comprising a toner particle that contains a colorant and a binder resin containing a styrene-acrylic resin and a crystalline resin, wherein a compatibility parameter (V) between the styrene-acrylic resin and the crystalline resin satisfies $0.40 \leq V \leq 1.10$.

The present invention can provide a toner that exhibits an excellent colorant dispersibility and hence maintains the formation of a high-quality image, that is capable of low-temperature fixing, and that has a satisfactory heat-resistant storability and a satisfactory durability.

Further features of the present invention will become apparent from the following description of exemplary embodiments (with reference to the attached drawings).

DESCRIPTION OF THE EMBODIMENTS

Figure 1:
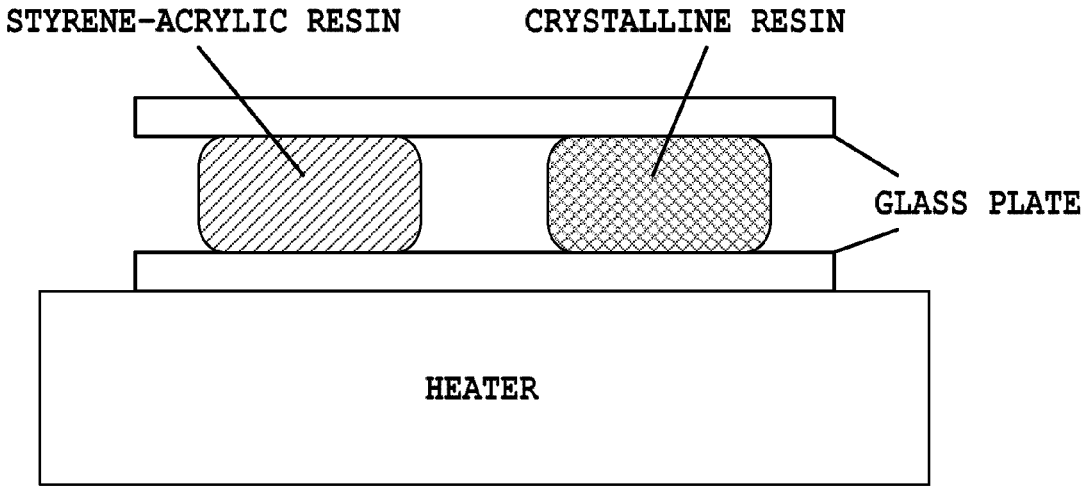
FIG. 1 is a diagram that shows the experimental technique for measuring the compatibility parameter referenced by the present invention.

Embodiments of the present invention are specifically described in the following.

Under the present circumstances the inventors focused on the phenomena of compatibilization between the styrene-acrylic resin and the crystalline material (for example, a crystalline resin) upon toner melting. As a result of intensive investigations, it was discovered that the toner of the present invention exhibits its effects due to control of the compatibility parameter into a specified range achieved via modifications of the composition and structure of the binder resin.

The detailed mechanism is not clear, but in a short-lived heating phenomenon such as the fixing process in electrophotography, a faster velocity of compatibilization (amount of compatibilization per unit time, hereinafter referred as compatibility parameter (V)) between the binder resin and the crystalline resin provides a more uniform compositional state for the toner during fixing and after fixing, and as a consequence separation between the styrene-acrylic resin and crystalline resin is not present in the fixed image and the colorant dispersibility is then not degraded. It is thought that, for this same reason, a large effect is obtained in terms of reducing the glass transition temperature (Tg) of the toner during fixing and the low-temperature fixability is then improved. The procedure for measuring the compatibility parameter in the present invention is described below.

In the present invention, the velocity of compatibilization (the compatibility parameter) between the styrene-acrylic resin and the crystalline resin is evaluated using the degree of colorant penetration as an index. In a system in which two different polymers are compatible with one another upon melting, it is thought that the interface between these polymers assumes a compatibilized state and it is then easy for a colorant to transfer from one into the other and the colored area due to the colorant undergoes an increase. It is also thought that in a system in which compatibilization is inhibited, the occurrence of colorant transfer is also inhibited due to a liquid-liquid phase separation.

The compatibility parameter (V) was obtained in the present invention by quantifying this colorant penetration and calculating the amount of penetration as a function of time. In pursuit of verification of whether compatibilization is actually occurring in the method of the present invention, peaks originating with the crystalline resin were observed when the colorant-penetrated part of the styrene-acrylic resin phase was imaged with an infrared microscope (IR microscope). When the surface unevenness was imaged using a laser microscope for the cooled sample, a correlation was found between the degree of penetration for the colorant and the degree of penetration for the unevenness image deriving from the crystalline resin. It was concluded based on the preceding that quantification of the compatibilization velocity is valid as a compatibility parameter in the present invention.

The compatibility parameter (V) between the styrene-acrylic resin and the crystalline resin satisfies $0.40 \leq V \leq 1.10$ for the toner of the present invention. When the value of compatibility parameter (V) exceeds 1.10, compatibilization between the styrene-acrylic resin and the crystalline resin occurs to an excessive degree during heating during toner production, leading to a deterioration in the heat-resistant storability and the durability due to an excessive softening of the toner post-production. When the value of compatibility parameter (V) is below 0.40, an adequate compatibilization effect is not obtained and the colorant dispersibility and low-temperature fixability cannot be improved. A preferred range for the compatibility parameter (V) is $0.65 \leq V \leq 0.95$. With regard to the method for controlling the compatibility parameter (V), during toner production the styrene-acrylic resin and crystalline resin assume a phase-separated structure, and structures must be selected whereby compatibilization readily proceeds during fixing (during heating); however, for example, the compatibility parameter (V) can be controlled through suitable combinations of the compositions and structures of the styrene-acrylic resin and crystalline resin in the binder resin, as described in the following.

Specifically, control can be carried out by, for example, the following method.

A larger compatibility parameter (V) is provided when the block polymer described below has a larger proportion of amorphous segment, while a smaller compatibility parameter (V) is provided when the proportion of the amorphous segment is lower. In addition, a larger compatibility parameter (V) is provided when the crystalline resin has a lower weight-average molecular weight.

A styrene-acrylic resin is preferably the main component of the binder resin present in the toner particle in the present invention. Here, main component means that the styrene-acrylic resin content in the binder resin is at least 50 mass %.

When the styrene-acrylic resin content in the binder resin is at least 50 mass %, the heat-resistant storability can be maintained because phase separation from the crystalline resin then readily occurs during toner particle production and a decline in the glass transition temperature (Tg) can be suppressed. Moreover, the elasticity necessary for the durability is maintained and the production of development stripes is suppressed even during extended printing and an excellent image can then be obtained.

The crystalline resin in the present invention is preferably a block polymer that has a polyester segment and a vinyl polymer segment wherein this polyester segment has a structure represented by the following formula (1) (the formula (1) unit) and a structure represented by the following formula (2) (the formula (2) unit).

[Chemical formula 1]

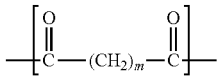

(1)

(in formula (1), m represents an integer from at least 6 to not more than 14 (preferably from at least 7 to not more than 12))

[Chemical formula 2]

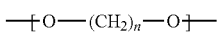

(2)

(in formula (2), n represents an integer from at least 6 to not more than 16 (preferably from at least 8 to not more than 14))

This polyester segment can be produced from, for example, a dicarboxylic acid represented by the following formula (A), or its alkyl ester or anhydride, and a diol represented by the following formula (B). This polyester segment is produced by their condensation polymerization.

$$HOOC—(CH_2)_m—COOH \quad \text{formula (A)}$$

(m in the formula represents an integer from at least 6 to not more than 14 (preferably from at least 7 to not more than 12))

$$HO—(CH_2)_n—OH \quad \text{formula (B)}$$

(n in the formula represents an integer from at least 6 to not more than 16 (preferably from at least 8 to not more than 14))

As long as the same subskeleton is produced in the polyester segment, the dicarboxylic acid may be used in the form of a compound in which the carboxyl group has been alkyl (having preferably from at least 1 to not more than 4 carbon atoms) esterified or a compound provided by conversion into the anhydride.

Here, the "crystalline resin" in the present invention indicates the presence in a differential scanning calorimetric measurement (DSC) of a clear endothermic peak lacking a stepwise change in the endothermic quantity.

Even when a crystalline resin has the form of a block entity of crystalline segments and amorphous segments, this is included within the category of crystalline resins when a clear endothermic peak is present in the differential scanning calorimetric measurement (DSC).

When a crystalline resin having a vinyl polymer segment is added to a binder resin that contains a styrene-acrylic resin, upon heating of the toner, compatibilization and uniformization occur immediately and the Tg reducing effect is readily expressed. By having the polyester segment have a structure represented by formula (1) and a structure represented by formula (2), a state of phase separation from the styrene-acrylic resin is maintained post-toner production and a decline in the heat-resistant storability is suppressed and problems such as blocking are inhibited. When the number of carbons in the diol and carboxylic acid in the preceding formulas are in the specified ranges, the polyester segment then has a high degree of crystallinity and due to this the phase separation is excellent and the heat-resistant storability can be maintained. Moreover, because an overly strong crystallization does not occur, the dispersibility by the crystalline resin in the styrene-acrylic resin is not degraded and a reduction in colorant dispersibility during fixing is suppressed.

The melting point of the crystalline resin is preferably from at least 55° C. to not more than 90° C. The occurrence of blocking in the toner is suppressed and the heat-resistant storability is further improved for 55° C. and above. When, on the other hand, the melting point is not more than 90° C., a low temperature is then required to melt the crystalline resin and low-temperature fixability is easily attained as a result. A more preferred range for the melting point is from at least 60° C. to not more than 82° C.

The melting point of the crystalline resin can be controlled into the indicated range, for example, by changing the constituent diol and the constituent dicarboxylic acid.

The weight-average molecular weight (Mw) of the vinyl polymer segment is preferably from at least 4,000 to not more than 15,000, and the ratio (Mw/Mn) of the weight-average molecular weight (Mw) of the vinyl polymer segment to the number-average molecular weight (Mn) of the vinyl polymer segment is preferably from at least 1.5 to not more than 3.5. When the weight-average molecular weight (Mw) of the vinyl polymer segment is at least 4,000, it can readily function as a starting point for compatibilization with the styrene-acrylic resin and due to this the low-temperature fixability can be further improved. Moreover, the properties of the vinyl polymer segment are then readily expressed and reductions in the heat-resistant storability and durability are readily inhibited. When, on the other hand, the weight-average molecular weight (Mw) of the vinyl polymer segment is not more than 15,000, the sharp melt property conferred by the polyester segment is more easily maintained and the effect on the low-temperature fixability is raised.

When the ratio (Mw/Mn) of the weight-average molecular weight (Mw) of the vinyl polymer segment to the number-average molecular weight (Mn) of the vinyl polymer segment is at least 1.5, the fixing region for the crystalline resin tends to be broadened due to the width of the molecular weight that is obtained. When, on the other hand, Mw/Mn is not more than 3.5, the occurrence of a decline in the heat-resistant storability and a decline in the durability due to the low-molecular weight component tends to be inhibited and the occurrence of a decline in the gloss due to the high-molecular weight component tends to be inhibited.

A more preferred range for the weight-average molecular weight (Mw) of the vinyl polymer segment is from at least 6,000 to not more than 13,000 and a more preferred range for its Mw/Mn is from at least 1.7 to not more than 3.3. The weight-average molecular weight (Mw) of the vinyl polymer segment and its Mw/Mn can be controlled into the indicated ranges by adjusting the monomer concentration, the initiator concentration, and the temperature.

The content of the crystalline resin in the binder resin is preferably from at least 2.0 mass % to not more than 50.0 mass % and is more preferably from at least 6.0 mass % to not more than 50.0 mass %. When the content of the crystalline resin in the binder resin is at least 2.0 mass % (more preferably at least 6.0 mass %), the Tg of the styrene-acrylic resin is lowered upon melting and separation of the styrene-acrylic resin from the crystalline resin upon melting are inhibited, which are effects of the present invention, and the colorant dispersibility during fixing and the low-temperature fixability are further improved. When, on the other hand, this content is not more than 50.0 mass %, the resistance to stresses can be maintained and the durability is further enhanced and the occurrence of image problems, e.g., development stripes and so forth, is suppressed.

A preferred range for the crystalline resin content is from at least 15.0 mass % to not more than 45.0 mass %, and a more preferred range is from at least 20.0 mass % to not more than 40.0 mass %.

In the present invention, the mass ratio between the polyester segment and the vinyl polymer segment in the crystalline resin is preferably from 40:60 to 80:20 and is more preferably from 40:60 to 70:30. When the mass ratio for the polyester segment is at least 40, the properties of the polyester segment are then satisfactorily expressed and the effect of the sharp melt property is more readily expressed. When, on the other hand, the mass ratio for the polyester segment is not more than 80 (and more preferably not more than 70), the properties of the vinyl polymer segment are then readily maintained and the occurrence of a decline in the heat-resistant storability is inhibited as a consequence. A more preferred range for the mass ratio between the polyester segment and the vinyl polymer segment in the crystalline resin is from 45:55 to 60:40.

The weight-average molecular weight (Mw) of the crystalline resin in the present invention is preferably from at least 15,000 to not more than 45,000 and is more preferably from at least 20,000 to not more than 45,000. The ratio (Mw/Mn) of the weight-average molecular weight (Mw) of the crystalline resin to the number-average molecular weight (Mn) of the crystalline resin is preferably from at least 1.5 to not more than 3.5. When the weight-average molecular weight (Mw) of the crystalline resin is at least 15,000 (more preferably at least 20,000), the mechanical strength of the crystalline resin is then maintained and a high durability is easily attained. At, on the other hand, 45,000 and below, molecular motion readily occurs and the plasticizing effect upon melting then tends to be easily obtained. A more preferred range for the weight-average molecular weight (Mw) of the crystalline resin is from at least 23,000 to not more than 40,000 and an even more preferred range is from at least 25,000 to not more than 37,000.

When the ratio (Mw/Mn) of the weight-average molecular weight (Mw) of the crystalline resin to the number-average molecular weight (Mn) of the crystalline resin is at least 1.5, the fixing region for the crystalline resin tends to be broadened due to the width of the molecular weight that is obtained. When, on the other hand, Mw/Mn is not more than 3.5, the occurrence of a decline in the heat-resistant storability and a decline in the durability due to the low-molecular weight component tends to be inhibited and the occurrence of a decline in the gloss due to the high-molecular weight component tends to be inhibited. A more preferred range for Mw/Mn is from at least 1.7 to not more than 2.8.

The weight-average molecular weight (Mw) and Mw/Mn of the crystalline resin can be controlled into the indicated ranges by adjusting, for example, the timing of monomer addition during crystalline resin production, the temperature, and so forth.

A radical-polymerizable vinylic polymerizable monomer may be used in the present invention as the polymerizable monomer constituting the styrene-acrylic resin. A monofunctional polymerizable monomer or a polyfunctional polymerizable monomer can be used as this vinylic polymerizable monomer from the standpoint of phase separation between the styrene-acrylic resin and crystalline resin in the toner prior to fixing and from the standpoint of controlling the compatibility parameter during fixing into the specified range.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxylethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional polymerizable monomer may be used or a combination of two or more may be used; or, a combination of monofunctional polymerizable monomer and polyfunctional polymerizable monomer may be used; or, a single polyfunctional polymerizable monomer may be used or a combination of two or more may be used.

Among these vinylic polymerizable monomers, the use is preferred—from the standpoint of the durability and developing characteristics of the toner—of styrene or a styrene derivative, either as a single selection or as a mixture of selections or as a mixture thereof with another vinylic polymerizable monomer.

Any production method may be used in the present invention as the production method for producing the toner particle; however, in order to maintain phase separation between the styrene-acrylic resin and the crystalline resin in the toner prior to fixing, the toner particle is preferably obtained by a toner particle production method in which the polymerizable monomer composition is granulated in an aqueous medium, such as a suspension polymerization method, an emulsion polymerization method, or a suspension granulation method.

The toner particle production method is described below using a suspension polymerization method, which is the most favorable among the toner particle production methods that may be used for the present invention.

The polymerizable monomer constituting the styrene-acrylic resin as described above, the crystalline resin, colorant, and other optional additives are dissolved or dispersed to uniformity using a dispersing device such as a homogenizer, ball mill, colloid mill, or ultrasonic disperser, and a polymerization initiator is dissolved therein to produce a polymerizable monomer composition. Toner particles are then produced by polymerizing this polymerizable monomer composition with it suspended in an aqueous medium that contains a dispersion stabilizer.

The polymerization initiator may be added at the same time that other additives are added to the polymerizable monomer, or it may be admixed just prior to suspension in the aqueous medium. In addition, the polymerization initiator, dissolved in solvent or polymerizable monomer, may be added immediately after granulation and before the start of the polymerization reaction.

In the case of polymerization methods that use an aqueous medium, such as suspension polymerization methods, a polar resin may be added to the aforementioned polymerizable monomer composition. A promotion of the encapsulation of the crystalline resin can be pursued through this addition of a polar resin.

Polyester-type resins and carboxyl-containing styrenic resins are preferred for this polar resin. By using a polyester-type resin or carboxyl-containing styrenic resin for the polar resin, these resins are unevenly distributed to the surface of the toner particle to form a shell and the lubricity intrinsic to these resins can be expected.

A resin formed by the condensation polymerization of the acid component monomer and alcohol component monomer exemplified herebelow can be used as the polyester-type resin used as a polar resin. The acid component monomer can be exemplified by terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, and trimellitic acid.

The alcohol component monomer can be exemplified by ethylene glycol, diethylene glycol, triethylene glycol, 1,2-propylene glycol, 1,3-propylene glycol, 1,4-butanediol, neopentyl glycol, the alkylene glycols and polyalkylene glycols of 1,4-bis(hydroxymethyl)cyclohexane, bisphenol A, hydrogenated bisphenols, ethylene oxide adducts on bisphenol A, propylene oxide adducts on bisphenol A, glycerol, trimethylolpropane, and pentaerythritol.

The carboxyl group-containing styrenic resin used for the polar resin is preferably, for example, a styrenic acrylic acid copolymer, a styrenic methacrylic acid copolymer, or a styrenic maleic acid copolymer, wherein styrene-acrylate ester-acrylic acid copolymers support facile control of the amount of charge and are thus preferred.

The carboxyl group-containing styrenic monomer more preferably incorporates a monomer that bears a primary or secondary hydroxyl group. The specific polymer composition can be exemplified by styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers, and styrene-α-methylstyrene-2-hydroxyethyl methacrylate-methacrylic acid-methyl methacrylate copolymers. A resin that incorporates a monomer that bears a primary or secondary hydroxyl group has a high polarity and provides a better stability during long-term standing.

The content of this polar resin, expressed per 100.0 mass parts of the binder resin, is preferably from at least 1.0 mass parts to not more than 20.0 mass parts and more preferably from at least 2.0 mass parts to not more than 10.0 mass parts.

A known wax may be used in the present invention. Specific examples are petroleum waxes such as paraffin wax, microcrystalline wax, and petrolatum, and their derivatives; montan wax and its derivatives; hydrocarbon waxes obtained by the Fischer-Tropsch method and their derivatives; polyolefin waxes as typified by polyethylene, and their derivatives; and natural waxes such as carnauba wax and candelilla wax, and their derivatives, wherein the derivatives encompass the oxides as well as block copolymers and graft modifications with vinylic monomer. Other examples are alcohols such as higher aliphatic alcohols; fatty acids such as stearic acid and palmitic acid, and acid amides, esters and ketones thereof; hydrogenated castor oil and its derivatives; vegetable waxes; and animal waxes. A single one of these may be used or a combination may be used.

Among the preceding, the use of a polyolefin, a hydrocarbon wax obtained by the Fischer-Tropsch method, or a petroleum wax provides an even greater improvement in the durability and transferability. An oxidation inhibitor may be added to these waxes within a range that does not exert an influence on the toner charging performance. These waxes are preferably used, expressed per 100.0 mass parts of the binder resin, at from at least 1.0 mass parts to not more than 30.0 mass parts.

The melting point of the wax in the present invention is preferably in the range from at least 30° C. to not more than 120° C., while the range of from at least 60° C. to not more than 100° C. is more preferred.

By using a wax that has such a thermal characteristic, starting with the excellent fixing performance of the obtained toner, the release action conferred by the wax will be efficiently expressed and a satisfactory fixing region will be maintained.

The following organic pigments, organic dyes, and inorganic pigments are examples of the colorants that may be used in the present invention.

The cyan colorant can be exemplified by copper phthalocyanine compounds and their derivatives, anthraquinone compounds, and basic dye lake compounds. Specific examples are C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds, and can be specifically exemplified by the following: C. I. Pigment Red 2, C. I. Pigment Red 3, C. I. Pigment Red 5, C. I. Pigment Red 6, C. I. Pigment Red 7, C. I. Pigment Violet 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

The yellow colorant can be exemplified by condensed azo compounds, isoindolinone compounds, anthraquinone compounds, azo metal complexes, methine compounds, and allylamide compounds and can be specifically exemplified by the following: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 185, C. I. Pigment Yellow 191, and C. I. Pigment Yellow 194.

The black colorant can be exemplified by carbon black and by black colorants provided by color mixing using the yellow, magenta, and cyan colorants described above to give a black color.

These colorants can be used individually or in mixture and can be used in the form of a solid solution. The colorant used in the present invention should be selected considering the hue angle, chroma, lightness, lightfastness, and OHP transparency and the dispersibility in the toner particle.

The colorant is preferably used at from 1.0 mass parts to not more than 20.0 mass parts per 100.0 mass parts of the binder resin.

When the toner particle is obtained using a suspension polymerization method, considering the polymerization inhibiting action that colorants have and their aqueous phase migration behavior, a colorant is preferably used that has been subjected to a hydrophobic treatment with a substance that does not inhibit the polymerization. In a preferred method for subjecting a dye to a hydrophobic treatment, the polymerizable monomer is polymerized in advance in the presence of the dye to obtain a colored polymer and the thusly obtained colored polymer is added to the polymerizable monomer composition.

With a carbon black, a hydrophobic treatment may be carried out just as for a dye, supra, but in addition the treatment may be performed with a substance (a polyorganosiloxane) that reacts with the surface functional groups on the carbon black.

A charge control agent or a charge control resin may be used in the present invention.

A known charge control agent may be used for this charge control agent, while in particular a charge control agent is preferred that supports a fast triboelectric charging speed and that can stably maintain a constant or prescribed triboelectric charge quantity. Moreover, when the toner particle is to be produced by a suspension polymerization method, a charge control agent is particularly preferred that exhibits little inhibitory effect on the polymerization and that is substantially not soluble in the aqueous medium.

Charge control agents include those that control the toner to a negative chargeability and those that control the toner to a positive chargeability. Charge control agents that control the toner to a negative chargeability can be exemplified by the following: monoazo metal compounds; acetylacetone metal compounds; metal compounds of aromatic hydroxycarboxylic acids, aromatic dicarboxylic acids, hydroxycarboxylic acids, and dicarboxylic acids; aromatic hydroxycarboxylic acids, aromatic monocarboxylic acids, and aromatic polycarboxylic acids and their metal salts, anhydrides, and esters; phenol derivatives such as bisphenol; urea derivatives; metal-containing salicylic acid-type compounds; metal-containing naphthoic acid-type compounds; boron compounds; quaternary ammonium salt; calixarene; and charge control resins.

Charge control agents that control the toner to a positive chargeability, on the other hand, can be exemplified by the following: guanidine compounds; imidazole compounds; quaternary ammonium salts such as tributylbenzylammonium 1-hydroxy-4-naphthosulfonic acid salt, tetrabutylammoniumtetrafluoroborate and the analogous onium salts, such as the phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; and charge control resins.

A single one of these charge control agents or charge control resins may be added, or combinations of two or more may be added.

Among these charge control agents, metal-containing salicylic acid-type compounds are preferred and metal-containing salicylic acid-type compounds in which the metal is aluminum or zirconium are preferred in particular.

The amount of addition of the charge control agent or charge control resin, expressed per 100.0 mass parts of the binder resin, is preferably from at least 0.01 mass parts to not more than 20.0 mass parts and is more preferably from at least 0.5 mass parts to not more than 10.0 mass parts.

A polymer or copolymer that has a sulfonic acid group, sulfonate salt group, or sulfonate ester group may be used as the charge control resin. In particular, a polymer having a sulfonic acid group, sulfonate salt group, or sulfonate ester group preferably contains at least 2 mass % and more preferably at least 5 mass %, expressed as the copolymerization ratio, of a sulfonic acid group-containing acrylamide-type monomer or sulfonic acid group-containing methacrylamide-type monomer.

The charge control resin preferably has a glass transition temperature (Tg) of from at least 35° C. to not more than 90° C., a peak molecular weight (Mp) of from at least 10,000 to not more than 30,000, and a weight-average molecular weight (Mw) of from at least 25,000 to not more than 50,000. The use of such a charge control resin can contribute to favorable triboelectric charging characteristics without affecting the thermal characteristics required of toner particles. Moreover, because the charge control resin contains a sulfonic acid group, the dispersibility of the colorant and the dispersibility of the charge control resin itself in the colorant-containing polymerizable monomer composition are improved, which can bring about additional improvements in the tinting strength, transparency, and triboelectric charging characteristics.

The polymerization initiator can be exemplified by organoperoxide-type initiators and azo-type polymerization initiators. The organoperoxide-type initiator can be exemplified by the following: benzoyl peroxide, lauroyl peroxide, di-α-cumyl peroxide, 2,5-dimethyl-2,5-bis(benzoylperoxy) hexane, bis(4-t-butylcyclohexyl)peroxydicarbonate, 1,1-bis (t-butylperoxy)cyclododecane, t-butyl peroxymaleate, bis(t-butylperoxy) isophthalate, methyl ethyl ketone peroxide, tert-butylperoxy 2-ethylhexanoate, diisopropyl peroxycarbonate, cumene hydroperoxide, 2,4-dichlorobenzoyl peroxide, and tert-butyl peroxypivalate.

The azo-type polymerization initiator can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

A redox initiator, which is the combination of an oxidizing substance and a reducing substance, may also be used as the polymerization initiator. The oxidizing substance can be exemplified by inorganic peroxides such as hydrogen peroxide and persulfate salts (sodium salt, potassium salt, and ammonium salt) and by oxidizing metal salts such as cerium (IV) salts. The reducing substance can be exemplified by reducing metal salts (iron(II) salts, copper(I) salts, and chromium(III) salts); ammonia; lower amines (amines having about from at least 1 to not more than 6 carbons, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (from at least 1 to not more than 6 carbons); ascorbic acid and its salts; and lower aldehydes (from at least 1 to not more than 6 carbons).

The polymerization initiator is selected with reference to its 10-hour half-life temperature, and a single polymerization initiator or a mixture of polymerization initiators may be used. The amount of addition of the polymerization initiator will vary with the desired degree of polymerization, but it is generally added at from at least 0.5 mass parts to not more than 20.0 mass parts per 100.0 mass parts of the polymerizable monomer.

A known chain transfer agent may also be added and used in order to control the degree of polymerization, and a polymerization inhibitor may also be added and used.

Various crosslinking agents may also be used when the polymerizable monomer is polymerized. The crosslinking agent can be exemplified by polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

Known inorganic compound dispersion stabilizers and known organic compound dispersion stabilizers can be used as the dispersion stabilizer that is used in the preparation of the aqueous medium. The inorganic compound dispersion stabilizers can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. The organic compound dispersion stabilizers, on the other hand, can be exemplified by polyvinyl alcohol, gelatin, methyl cellulose, methyl hydroxypropyl cellulose, ethyl cellulose, the sodium salt of carboxymethyl cellulose, polyacrylic acid and its salts, and starches. The amount of use of these dispersion stabilizers is preferably from at least 0.2 mass parts to not more 20.0 mass parts per 100.0 mass parts of the polymerizable monomer.

Among these dispersion stabilizers, when an inorganic compound dispersion stabilizer is used, a commercially available inorganic compound dispersion stabilizer may be used as such, but the inorganic compound may also be generated in the aqueous medium in order to obtain a dispersion stabilizer with a finer particle diameter. For example, in the case of tricalcium phosphate, it can be obtained by mixing an aqueous sodium phosphate solution with an aqueous calcium chloride solution under high-speed stirring.

An external additive for imparting various properties to the toner may be externally added to the toner particle. An external additive for improving toner flowability can be exemplified by finely divided inorganic particles such as finely divided silica particles, finely divided titanium oxide particles, and their finely divided composite oxide particles. Finely divided silica particles and finely divided titanium oxide particles are preferred among the finely divided inorganic particles.

The toner of the present invention can be obtained, for example, by externally mixing finely divided inorganic particles with the toner particles to induce the former's attachment to the toner particle surface. A known method may be used for the method of externally adding the finely divided inorganic particles. An example here is a method that performs a mixing process using a HENSCHEL® mixer (Mitsui Miike Chemical Engineering Machinery Co., Ltd.).

The finely divided silica particles can be exemplified by dry silica and fumed silica, which are produced by the vapor-phase oxidation of a silicon halide, and by wet silica, which is produced from water glass. Dry silica, which has little silanol group at the surface and within the finely divided silica particles and which has little $Na_2O$ and $SO_3^{2-}$, is preferred for the finely divided inorganic particles. In addition, the dry silica may be a finely divided composite particle of silica and another metal oxide, as provided by using another metal halide compound, such as aluminum chloride or titanium chloride, in combination with the silicon halide compound in the production process.

The triboelectric charge quantity for the toner can be adjusted, the environmental stability can be improved, and the flowability at high temperature and high humidity can be improved by subjecting the surface of the finely divided inorganic particles to a hydrophobic treatment with a treatment agent, and as a result the use of hydrophobically treated finely divided inorganic particles is preferred. When the finely divided inorganic particles externally added to the toner are hygroscopic, the triboelectric charge quantity of the toner and its flowability are reduced and a reduction in the durability and transferability is readily produced.

The treatment agent for executing the hydrophobic treatment on the finely divided inorganic particles can be exemplified by unmodified silicone varnishes, variously modified silicone varnishes, unmodified silicone oils, variously modified silicone oils, silane compounds, silane coupling agents, other organosilicon compounds, and organotitanium compounds. Silicone oils are preferred among the preceding. A single one of these treatment agents may be used or combinations of these treatment agents may be used.

The total amount of addition of the finely divided inorganic particles, expressed per 100.0 mass parts of the toner particles, is preferably from at least 1.0 mass parts to not more than 5.0 mass parts and is more preferably from at least 1.0 mass parts to not more than 2.5 mass parts. Viewed from the standpoint of the durability when added to the toner, the external additive preferably has a particle diameter that is not more than one-tenth of the average particle diameter of the toner particle.

The methods for measuring the various properties according to the present invention are described in the following.

<The Method for Measuring the Compatibility Parameter (V)>

The compatibility parameter (V) specified in the present invention is measured as follows.

(1) 1.0 mass parts of a colorant (C. I. Pigment Blue 15:3, a pigment) and 99.0 mass parts of the crystalline resin are mixed and heated at 150° C. to obtain a kneaded material (A). This kneaded material (A) and the styrene-acrylic resin (B) are sandwiched from above and below with glass plates (Matsunami cover glass (No. 1) 18 mm×18 mm) and spots with a thickness of 0.3 mm are formed. The measurement set up is shown in FIG. 1. This sample is heated to a temperature of 120° C. at 40° C./minute, causing the areas of the spots to broaden and causing the kneaded material (A) to come into contact with the styrene-acrylic resin (B) to form an interface. While maintaining the temperature at 120° C., the sample is held for 10 minutes, 20 minutes, or 30 minutes from the time point at which the interface formed as observed with a microscope (500×) and is then returned to room temperature. This time was designated T (minutes).

(2) An image (digital photograph) at the time point of interface formation (after 0 minutes), an image after 10 minutes, the image after 20 minutes, and an image after 30 minutes are recorded using the instrumentation and conditions given below. The interface image was recorded at 5 points at each time (T).

instrument: VK-X200 Shape Measurement Laser Microscope (Keyence Corporation)

recording conditions focal point: set so as to match the resin surface on the top of the sample (side opposite from the heat source); brightness setting value: 45; gain: 0 dB; white balance: R=140, B=155

Figure 2:
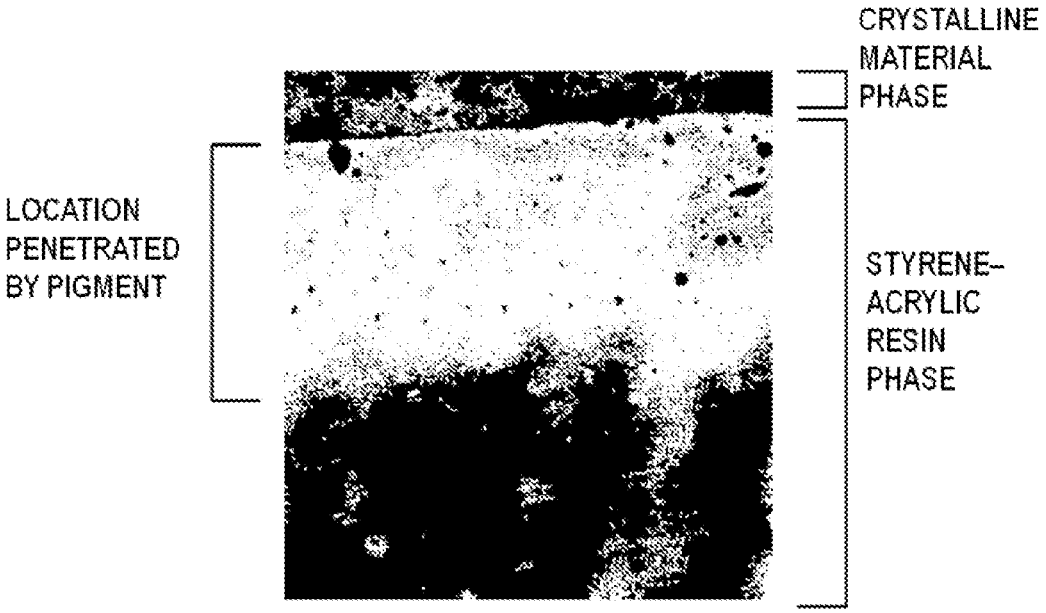
FIG. 2 is a binarized image of the post-measurement image in the measurement of the compatibility parameter referenced by the present invention.

(3) The color of the colorant (pigment)-colored region is extracted within a 400×600 $\mu m^2$ field from the interface region in the recorded image. Binarization is performed for the extracted region and the non-extracted region. In the execution of this binarization, the image processing conditions given below were used and the area was calculated. The value given by dividing the binarization-processed area by the total image processing area (400×600 $\mu m^2$) was designated A (%). The value of A was taken to be the average value for the images at the five points. A binarized recorded image is shown in FIG. 2. In FIG. 2, the white region represents the area colored by the pigment and the black region represents a noncolored styrene-acrylic resin phase or the crystalline resin phase.

(4) Using T (minutes) for the horizontal axis and A (%) for the vertical axis and letting T=0 minutes be a colored area of 0%, the value of A at T=10 minutes, the value of A at T=20 minutes, and the value of A at T=30 minutes were plotted and the slope of the straight line, as determined by linear approximation, was taken to be the compatibility parameter (V).

image processing program: VK-X200 observation application binarization processing:

Using the interface as the horizontal direction, the total area for binarization processing was made the range of the rectangle with a length of 600 μm and a width of 400 μm that had the interface for 1 edge.

The pigment-stained region of the styrene-acrylic resin is extracted at settings of color tolerance=20 and transparency=0 and the binarization processing is performed. After performing noise elimination at a setting of 20 pixels, void filling processing is run at a setting of 10 pixels and measurement of the area is performed. This process was carried out 3 times and the average was taken to be the area.

<Production of Resin in which the Crystalline Resin is Mixed with Styrene-Acrylic Resin>

When the toner particle is produced using a suspension polymerization method, a resin produced proceeding in the same manner as in the method of producing the particular toner particle—with the exception that the Pigment Blue 15:3, polar resin, wax, and crystalline resin for the particular toner particle are not used—is used as the styrene-acrylic resin in the present invention. Here, when the weight-average molecular weight (Mw) of the styrene-acrylic resin provided without using the particular materials diverged by 3,000 or more from the weight-average molecular weight (Mw) for the toner particles, the conditions, such as the amount of polymerization initiator and polymerization temperature, is adjusted to correct the divergence in the weight-average molecular weight. The individual styrene-acrylic resins were produced as indicated in the examples in the present invention.

<The Method for Measuring the Molecular Weight>

The weight-average molecular weight (Mw) and number-average molecular weight (Mn) of the resins and polymers are measured as described in the following by gel permeation chromatography (GPC).

First, the resin or polymer is dissolved in tetrahydrofuran (THF) at room temperature. The resulting solution is filtered across a "MyShoriDisk" (Tosoh Corporation) solvent-resistant membrane filter having a pore diameter of 0.2 μm to obtain a sample solution. This sample solution is adjusted to bring the concentration of the THF-soluble component to 0.8 mass %. The measurement is carried out under the following conditions using this sample solution.

instrument: "HLC-8220GPC" high-performance GPC instrument (Tosoh Corporation)

column: 2×LF-604 (Showa Denko Kabushiki Kaisha)

eluent: THF flow rate: 0.6 mL/minute oven temperature: 40° C.

sample injection amount: 0.020 mL

The molecular weight of the sample is determined using a molecular weight calibration curve constructed using standard polystyrene resins (for example, trade name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

The measurement of the molecular weight of the vinyl polymer segment of the crystalline resin is carried out after hydrolysis of the polyester segment of the crystalline resin.

The specific method is as follows. 5 mL of dioxane and 1 mL of a 10 mass % aqueous potassium hydroxide solution are added to 30 mg of the crystalline resin and the polyester segment is hydrolyzed by shaking for 6 hours at a temperature of 70° C. The solution is then dried to prepare a sample for measurement of the molecular weight of the vinyl polymer segment. The process after this is carried out in the same manner as the method described above for measuring the resins and polymers.

<Method for Measuring the Mass Ratio Between the Polyester Segment and the Vinyl Polymer Segment in the Crystalline Resin (the C/A Ratio)>

The mass ratio between the polyester segment and the vinyl polymer segment in the crystalline resin was measured using nuclear magnetic resonance spectroscopy ($^1$H-NMR) [400 MHz, $CDCl_3$, room temperature (25° C.)] measurement instrumentation: JNM-EX400 FT-NMR instrument (JEOL Ltd.)

measurement frequency: 400 MHz pulse condition: 5.0 μs frequency range: 10500 Hz number of integrations: 64

The mass ratio between the polyester segment and the vinyl polymer segment (the C/A ratio) was calculated from the integration values in the obtained spectrum.

<The Method for Measuring the Melting Point (Tm)>

The melting point (Tm) of, e.g., the crystalline resin and so forth, is measured based on ASTM D 3418-82 using a "Q1000" differential scanning calorimeter (TA Instruments). The melting points of indium and zinc are used for temperature correction in the instrument detection section, and the heat of fusion of indium is used for correction of the amount of heat.

Specifically, 5 mg of the sample is accurately weighed out and is introduced into the aluminum pan, and, using an empty aluminum pan as the reference, a measurement is run at a temperature raising rate of 10° C./minute in the measurement temperature range from 30° C. to 200° C. The measurement is run by raising up to 200° C., then cooling to 30° C., and then raising up again. The melting point (Tm) is taken to be the peak temperature (° C.) of the maximum endothermic peak in the DSC curve in this second temperature raising process in the temperature range from a temperature of 30° C. to 200° C.

EXAMPLES

The present invention is more specifically described through the examples provided below, but the present invention is not limited to or by these examples. Unless specifically indicated otherwise, the number of parts and % used in the examples and comparative examples are in all instances on a mass basis.

The crystalline materials used in the examples are described first.

<Production of Crystalline Material (Crystalline Resin) 1>

100.0 parts of sebacic acid and 108.0 parts of 1,12-dodecanediol were added to a reactor fitted with a stirrer, thermometer, nitrogen introduction tube, water separation tube, and pressure-reduction apparatus, and were heated to a temperature of 130° C. while stirring. 0.7 parts of titanium (IV) isopropoxide was added as an esterification catalyst and the temperature was raised to 160° C. and a condensation polymerization was run over hours. After this, the temperature was raised to 180° C. and the reaction was run while reducing the pressure until the desired molecular weight was reached, this yielding a polyester (1). The weight-average molecular weight (Mw) of polyester (1), as measured by the previously described method, was 18,000, and its melting point (Tm) was 88° C.

100.0 parts of polyester (1) and 440.0 parts of dry chloroform were then added to a reactor fitted with a stirrer, thermometer, and nitrogen introduction tube. After complete dissolution, 5.0 parts of triethylamine was added and 15.0 parts of 2-bromoisobutyryl bromide was gradually added with ice cooling. This was followed by stirring for 24 hours at room temperature (25° C.)

This resin solution was gradually added dropwise to a vessel holding 550.0 parts of methanol in order to reprecipitate the resin fraction, followed by filtration, purification, and drying to obtain a polyester (2).

Then, 100.0 parts of the thusly obtained polyester (2), 300.0 parts of styrene, 3.5 parts of copper(I) bromide, and 8.5 parts of pentamethyldiethylenetriamine were added to a reactor fitted with a stirrer, thermometer, and nitrogen introduction tube, and a polymerization reaction was run at a temperature of 110° C. while stirring. The reaction was stopped once the desired molecular weight was reached, followed by reprecipitation with 250.0 parts of methanol, filtration, purification, and removal of the unreacted styrene and the catalyst. Drying was subsequently carried out with a vacuum dryer set to 50° C. to obtain the crystalline material 1. The properties of the obtained crystalline material are given in Table 3.

<Production of Crystalline Materials 2 to 13, 15, 16, 19, 21, 23, and 24>

Crystalline materials 2 to 13, 15, 16, 19, 21, 23, and 24 were obtained proceeding as in the Production of Crystalline Material 1, but changing to the starting materials and production conditions as shown in Table 1. The properties of the obtained crystalline materials are shown in Table 3.

<Production of Crystalline Material 14>

100.0 mass parts of xylene was added while performing nitrogen substitution to a reactor fitted with a stirrer, thermometer, nitrogen introduction tube, and pressure-reduction apparatus and was heated under reflux at a liquid temperature of 140° C. To this solution was added a mixture of 100.0 mass parts of styrene and 6.0 mass parts of dimethyl 2,2'-azobis(2-methylpropionate) dropwise over 3 hours, and after the completion of the dropwise addition the solution was stirred for 3 hours. This was followed by removal of the xylene and residual styrene at 160° C. and 1 hPa to obtain a vinyl polymer (1).

0.43 parts of titanium(IV) isopropoxide as an esterification catalyst was then added to 100.0 mass parts of the thusly obtained vinyl polymer (1), 88.0 parts of xylene as organic solvent, and 74.2 mass parts of 1,12-dodecanediol in a reactor fitted with a stirrer, thermometer, nitrogen introduction tube, water separation tube, and pressure-reduction apparatus, and a reaction was run for 4 hours at 150° C. under a nitrogen atmosphere. This was followed by the addition of 63.0 mass parts of sebacic acid and reaction for 3 hours at 150° C. and 4 hours at 180° C. This was followed by additional reaction at 180° C. and 1 hPa until the desired weight-average molecular weight (Mw) was reached to obtain crystalline material 14.

<Production of Crystalline Materials 17, 18, 20, and 22 and 25, 27, and 28>

Crystalline materials 17, 18, 20, and 22 and 25, 27, and 28 were obtained proceeding as in the Production of Crystalline Material 14, but changing to the starting materials and production conditions as shown in Table 2. The properties of the obtained crystalline materials are shown in Table 3.

<Production of Crystalline Material 26>

100.0 mass parts of sebacic acid and 93.5 mass parts of 1,10-decanediol were added to a reactor fitted with a stirrer, thermometer, nitrogen introduction tube, water separation tube, and pressure-reduction apparatus, and were heated to a temperature of 130° C. while stirring. 0.7 mass parts of titanium(IV) isopropoxide was added and the temperature was then raised to 160° C. and a condensation polymerization was run over 5 hours. 15.0 mass parts of acrylic acid and 140.0 mass parts of styrene were added dropwise over 1 hour. Stirring was continued for 1 hour while maintaining 160° C., followed by removal of the monomer for the styrenic resin component for 1 hour at 8.3 kPa. The temperature was then raised to 210° C. and a reaction was run until the desired molecular weight was reached, thereby obtaining the crystalline material 26. The properties of the obtained crystalline material 26 are shown in Table 3.

TABLE 1

| crystalline | polyester segment | | | | | vinyl polymer segment | | |
|---|---|---|---|---|---|---|---|---|
| material NO. | acid monomer | mass parts | alcohol monomer | mass parts | reaction conditions | vinyl monomer | mass parts | reaction temperature |
| 1 | sebacic acid | 100.0 | 1,12-dodecanediol | 108.0 | 160° C./5 H | styrene | 300.0 | 110° C. |
| 2 | sebacic acid | 100.0 | 1,9-nonanediol | 83.0 | 160° C./5 H | styrene | 300.0 | 110° C. |
| 3 | sebacic acid | 100.0 | 1,12-dodecanediol | 108.0 | 160° C./5 H | styrene | 250.0 | 110° C. |
| 4 | suberic acid | 100.0 | 1,7-heptanediol | 79.4 | 160° C./5 H | styrene | 300.0 | 110° C. |
| 5 | dodecane dioic acid | 100.0 | 1,12-dodecanediol | 94.0 | 160° C./5 H | styrene | 250.0 | 110° C. |
| 6 | sebacic acid | 100.0 | 1,6-hexanediol | 83.0 | 160° C./5 H | styrene | 450.0 | 110° C. |
| 7 | sebacic acid | 100.0 | 1,12-dodecanediol | 108.0 | 160° C./5 H | styrene | 300.0 | 110° C. |
| 8 | sebacic acid | 100.0 | 1,12-dodecanediol | 108.0 | 160° C./5 H | styrene | 200.0 | 110° C. |
| 9 | sebacic acid | 100.0 | 1,12-dodecanediol | 83.0 | 160° C./5 H | styrene | 450.0 | 110° C. |
| 10 | sebacic acid | 100.0 | 1,12-dodecanediol | 108.0 | 160° C./5 H | styrene | 250.0 | 110° C. |
| 11 | sebacic acid | 100.0 | 1,12-dodecanediol | 108.0 | 160° C./5 H | styrene | 350.0 | 110° C. |
| 12 | sebacic acid | 100.0 | 1,12-dodecanediol | 108.0 | 160° C./5 H | styrene | 250.0 | 110° C. |
| 13 | sebacic acid | 100.0 | 1,12-dodecanediol | 108.0 | 140° C./7 H | styrene | 250.0 | 110° C. |
| 15 | sebacic acid | 100.0 | 1,12-dodecanediol | 108.0 | 160° C./5 H | styrene | 250.0 | 110° C. |
| 16 | sebacic acid | 100.0 | 1,12-dodecanediol | 108.0 | 130° C./7 H | styrene | 300.0 | 110° C. |
| 19 | sebacic acid | 100.0 | 1,12-dodecanediol | 108.0 | 160° C./5 H | styrene | 300.0 | 100° C. |
| 21 | sebacic acid | 100.0 | 1,12-dodecanediol | 108.0 | 160° C./5 H | styrene | 300.0 | 90° C. |
| 23 | dodecane dioic acid | 100.0 | 1,12-dodecanediol | 84.0 | 160° C./5 H | styrene | 450.0 | 110° C. |
| 24 | pimelic acid | 100.0 | 1,6-hexanediol | 54.4 | 160° C./5 H | styrene | 300.0 | 110° C. |

TABLE 2

| crystalline material NO. | polyester segment | | vinyl polymer segment | | |
|---|---|---|---|---|---|
| | acid monomer | alcohol monomer | vinyl monomer | number of parts of initiator | reaction temperature (° C.) |
| 14 | sebacic acid | 1,12-dodecanediol | styrene | 6.0 | 140 |
| 17 | sebacic acid | 1,9-nonanediol | styrene | 6.0 | 140 |
| 18 | sebacic acid | 1,9-nonanediol | styrene | 6.0 | 140 |
| 20 | sebacic acid | 1,12-dodecanediol | styrene | 10.0 | 140 |
| 22 | sebacic acid | 1,12-dodecanediol | styrene | 10.0 | 130 |
| 25 | dodecane dioic acid | 1,12-dodecanediol | styrene | 6.0 | 140 |
| 27 | sebacic acid | 1,12-dodecanediol | styrene | 6.0 | 140 |
| 28 | sebacic acid | 1,12-dodecanediol | styrene | 6.0 | 140 |

TABLE 3

| crystalline | polyester segment | | vinyl polymer segment | | overall crystalline resin | | | |
|---|---|---|---|---|---|---|---|---|
| material NO. | Mw | Tm (° C.) | Mw | Mw/Mn | Mw | Mw/Mn | C/A ratio | Tm (° C.) |
| 1 | 18000 | 88 | 7500 | 1.8 | 33000 | 1.7 | 55/45 | 78 |
| 2 | 18500 | 73 | 7500 | 1.8 | 33000 | 1.7 | 55/45 | 63 |
| 3 | 16000 | 88 | 6200 | 1.8 | 32500 | 1.7 | 65/35 | 78 |
| 4 | 18500 | 68 | 7500 | 2.4 | 33000 | 2.1 | 55/45 | 62 |
| 5 | 20000 | 89 | 7500 | 1.8 | 33000 | 1.7 | 55/45 | 83 |
| 6 | 18500 | 73 | 7500 | 1.8 | 34000 | 1.7 | 55/45 | 59 |
| 7 | 10500 | 88 | 4000 | 1.8 | 21000 | 1.7 | 55/45 | 78 |
| 8 | 26000 | 88 | 13500 | 2.8 | 44000 | 1.7 | 55/45 | 78 |
| 9 | 13000 | 88 | 9500 | 1.8 | 32000 | 1.7 | 40/60 | 77 |
| 10 | 11000 | 88 | 6200 | 1.8 | 36000 | 1.7 | 70/30 | 79 |
| 11 | 6000 | 88 | 10200 | 1.8 | 31500 | 1.7 | 35/65 | 76 |
| 12 | 26000 | 88 | 5400 | 1.8 | 37000 | 1.7 | 75/25 | 80 |
| 13 | 12000 | 88 | 5000 | 1.8 | 21000 | 1.5 | 60/40 | 78 |
| 14 | — | — | 12000 | 1.8 | 43000 | 3.3 | 55/45 | 78 |
| 15 | 10500 | 88 | 4500 | 1.8 | 19000 | 1.8 | 55/45 | 78 |
| 16 | 11000 | 88 | 4500 | 1.8 | 19000 | 1.3 | 55/45 | 78 |
| 17 | — | — | 13500 | 1.8 | 46000 | 3.5 | 55/45 | 63 |
| 18 | — | — | 13500 | 1.8 | 46000 | 3.8 | 55/45 | 63 |
| 19 | 19000 | 88 | 7500 | 1.6 | 36000 | 1.7 | 55/45 | 78 |
| 20 | — | — | 6800 | 3.4 | 36000 | 1.7 | 55/45 | 78 |
| 21 | 18500 | 88 | 7500 | 1.3 | 36000 | 1.6 | 55/45 | 78 |
| 22 | — | — | 6300 | 3.8 | 38000 | 3.3 | 55/45 | 78 |
| 23 | 19500 | 89 | 17500 | 1.8 | 55000 | 1.7 | 65/35 | 82 |
| 24 | 18500 | 53 | 7500 | 1.8 | 33000 | 1.7 | 55/45 | 53 |
| 25 | — | — | 13500 | 1.8 | 46000 | 3.8 | 65/35 | 82 |
| 26 | — | — | — | — | 78500 | 4.2 | 60/40 | 78 |
| 27 | — | — | 7000 | 1.8 | 15000 | 3.3 | 55/45 | 78 |
| 28 | — | — | 7000 | 1.8 | 14000 | 3.3 | 55/45 | 76 |

<Production of Toner 1>

An aqueous medium was prepared by adding 9.0 mass parts of tricalcium phosphate to 1300.0 mass parts of deionized water heated to a temperature of 60° C. and stirring at a stirring rate of 15,000 rpm using a TK Homomixer (Tokushu Kika Kogyo Co., Ltd.).

A mixture was prepared by mixing the following binder resin materials with stirring at a stirring rate of 100 rpm using a propeller-type stirring device.

styrene 50.7 mass parts
n-butyl acrylate 14.3 mass parts
crystalline material 1 35.0 mass parts
To this solution was then added
cyan colorant (C. I. Pigment Blue 15:3) 6.5 mass parts
negative charging charge control agent 0.5 mass parts
(BONTRON E-88, from Orient Chemical Industries Co., Ltd.)
hydrocarbon wax (Tm=78° C.) 9.0 mass parts
negative charging charge control resin 0.7 mass parts
(styrene/2-ethylhexyl acrylate/2-acrylamido-2-methylpropanesulfonic acid copolymer=88.0/6.0/5.0 (mass basis), Mw=33,000, Tg=83° C.)
polar resin 5.0 mass parts
(styrene-2-hydroxyethyl methacrylate-methacrylic acid-methyl methacrylate copolymer, acid value=10 mg KOH/g, Tg=80° C., Mw=15,000)

and the mixture was thereafter heated to a temperature of 65° C. followed by stirring at a stirring rate of 10,000 rpm with a TK Homomixer (Tokushu Kika Kogyo Co., Ltd.) to effect dissolution and dispersion and produce a polymerizable monomer composition.

This polymerizable monomer composition was introduced into the aforementioned aqueous medium and Perbutyl PV 6.0 mass parts
(10-hour half-life temperature=54.6° C. (NOF Corporation)) was added as a polymerization initiator and granulation was carried out by stirring at a temperature of 70° C. for 20 minutes at a stirring rate of 15,000 rpm using a TK Homomixer.

After transfer to a propeller-type stirrer and while stirring at a stirring rate of 200 rpm, the styrene and n-butyl acrylate, which were the polymerizable monomers in the polymerizable monomer composition, were polymerized for 5 hours at a temperature of 85° C. to produce a toner particle-containing slurry. The slurry was cooled after the completion of the polymerization reaction. The pH was brought to 1.4 by the addition of hydrochloric acid to the cooled slurry and the calcium phosphate salt was dissolved by stirring for 1 hour. Washing with water at 10-fold relative to the slurry was then performed followed by filtration and drying and subsequent adjustment of the particle diameter by classification to obtain toner particles. The toner particles contained 65.0 mass parts of a styrene-acrylic resin, 35.0 mass parts of the crystalline material (crystalline resin), 6.5 mass parts of the cyan colorant, 9.0 mass parts of the wax, 0.5 mass parts of the negative charging charge control agent, 0.7 mass parts of the negative charging charge control resin, and 5.0 mass parts of the polar resin.

A toner 1 was obtained by mixing 100.0 mass parts of these toner particles for 15 minutes using a HENSCHEL® mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. The properties of toner 1 are given in Table 4. Here, D1 is the number-average particle diameter and D4 is the weight-average particle diameter.

<Production of Toners 2 to 30 and Toners 34 to 41>

Toners 2 to 30 and toners 34 to 41 were obtained proceeding as in the method of producing toner 1, with the exception that the starting materials and parts of addition were changed as shown in Table 4. Physical properties of toners 2 to 30 and toners 34 to 41 are shown in Table 4.

<Production of Toner 31> styrene-acrylic resin 65.0 mass parts
(copolymer of styrene:n-butyl acrylate=75:25 (mass ratio)) (Mw=30,000, Tg=55° C.)
crystalline material 1 35.0 mass parts
methyl ethyl ketone 100.0 mass parts
ethyl acetate 100.0 mass parts
hydrocarbon wax (Tm=78° C.) 9.0 mass parts
cyan colorant (C. I. Pigment Blue 15:3) 6.5 mass parts
negative charging charge control resin 1.0 mass parts
(styrene/2-ethylhexyl acrylate/2-acrylamido-2-methylpropanesulfonic acid copolymer=88.0/6.0/5.0 (mass basis), Mw=33,000, Tg=83° C.)

These materials were dispersed for 3 hours using an attritor (Mitsui Mining & Smelting Co., Ltd.) to obtain a colorant-dispersed solution. On the other hand, an aqueous medium was prepared by adding 27.0 mass parts of calcium phosphate to 3000.0 mass parts of deionized water heated to a temperature of 60° C. and stirring at a stirring rate of 10,000 rpm using a TK Homomixer (Tokushu Kika Kogyo Co., Ltd.). The colorant-dispersed solution was introduced into the aqueous medium and the colorant particles were granulated by stirring for 15 minutes at a stirring rate of 12,000 rpm using a TK Homomixer under an $N_2$ atmosphere at a temperature of 65° C. After this, the TK Homomixer was replaced with an ordinary propeller stirrer and, while maintaining the stirring rate with the stirrer at 150 rpm, the internal temperature was raised to a temperature of 95° C. and the solvent was removed from the dispersion by holding for 3 hours, thus producing a dispersion of toner particles. Hydrochloric acid was added to the obtained toner particle dispersion to bring the pH to 1.4 and the calcium phosphate salt was dissolved by stirring for 1 hour. The dispersion was filtered and washed on a pressure filter to obtain a toner aggregate. This toner aggregate was subsequently pulverized and dried to obtain toner particles. The toner particles contained 65.0 mass parts of the styrene-acrylic resin, 35.0 mass parts of the crystalline material, 6.5 mass parts of the cyan colorant, 9.0 mass parts of the wax, and 1.0 mass parts of the negative charging charge control resin. A toner 31 was obtained by mixing 100.0 mass parts of these toner particles for 15 minutes using a HENSCHEL® mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. The properties of toner 31 are given in Table 4.

<Production of Toner 32>

(Production of a Resin Particle Dispersion 1)
styrene 78.0 mass parts
n-butyl acrylate 22.0 mass parts The preceding were mixed with dissolution; this was dispersed and emulsified in 120.0 mass parts of deionized water in which 1.5 mass parts of a nonionic surfactant (Sanyo Chemical Industries, Ltd.: Nonipol 400) and 2.2 mass parts of an anionic surfactant (Dai-ichi Kogyo Seiyaku Co., Ltd.: Neogen SC) were dissolved; and 1.5 mass parts of the polymerization initiator ammonium persulfate dissolved in 10.0 mass parts of deionized water was gradually introduced over 10 minutes while mixing. After nitrogen substitution, the contents were heated to a temperature of 70° C. while stirring and an emulsion polymerization was continued under these conditions for 4 hours to produce a resin particle dispersion 1 in which resin particles having an average particle diameter of 0.29 μm were dispersed.

(Production of a Resin Particle Dispersion 2)
A solution of
crystalline material 1 100.0 mass parts was dispersed and emulsified in 120.0 mass parts of deionized water in which 1.5 mass parts of a nonionic surfactant (Sanyo Chemical Industries, Ltd.: Nonipol 400) and 2.2 mass parts of an anionic surfactant (Dai-ichi Kogyo Seiyaku Co., Ltd.: Neogen SC) were dissolved. A resin particle dispersion 2 was produced in which resin particles having an average particle diameter of 0.31 μm were dispersed.

(Production of a Colorant Particle Dispersion)
cyan colorant (C. I. Pigment Blue 15:3) 20.0 mass parts
anionic surfactant 3.0 mass parts
(Dai-ichi Kogyo Seiyaku Co., Ltd.: Neogen SC)
deionized water 78.0 mass parts The preceding were mixed and were dispersed using a sand grinder mill (Nippon Coke & Engineering Co., Ltd.). When the particle size distribution in this colorant particle dispersion was measured using a particle distribution analyzer (LA-700 from Horiba, Ltd.), the average particle diameter of the colorant particles contained therein was 0.20 μm and coarse particles in excess of 1 μm were not observed.

(Production of a Wax Particle Dispersion)
hydrocarbon wax (Tm=78° C.) 50.0 mass parts
anionic surfactant 7.0 mass parts
(Dai-ichi Kogyo Seiyaku Co., Ltd.: Neogen SC)
deionized water 200.0 mass parts The preceding were heated to a temperature of 95° C.; dispersion was carried out using a homogenizer (IKA: Ultra-Turrax T50); and a dispersion treatment was then performed using a pressure-ejection homogenizer to produce a wax particle dispersion in which wax with an average particle size of 0.50 μm was dispersed.

(Production of a Charge Control Particle Dispersion)
metal compound of a dialkylsalicylic acid 5.0 mass parts
(negative charging charge control agent, BONTRON E-84, from Orient Chemical Industries Co., Ltd.)
anionic surfactant 3.0 mass parts
(Dai-ichi Kogyo Seiyaku Co., Ltd.: Neogen SC)
deionized water 78.0 mass parts
The preceding were mixed and were dispersed using a sand grinder mill.

(Mixture Production)
resin particle dispersion 1 150.0 mass parts
resin particle dispersion 2 77.5 mass parts
colorant particle dispersion 27.5 mass parts
wax particle dispersion 45.0 mass parts The preceding were introduced into a 1-liter separable flask fitted with a stirrer, condenser, and thermometer and were stirred. The resulting mixture was brought to pH=5.2 using 1 mol/L potassium hydroxide. 120.0 mass parts of an 8% aqueous sodium chloride solution was added dropwise as a coalescing agent to this mixture, and heating was carried out to a temperature of 55° C. while stirring. Upon reaching this temperature, 10.0 mass parts of the charge control particle dispersion was added. After holding for 2 hours at a temperature of 55° C., observation with an optical microscope showed that aggregate particles with an average particle diameter of 3.3 μm had been formed.

A supplementary addition of 3.0 mass parts of an anionic surfactant (Dai-ichi Kogyo Seiyaku Co., Ltd.: Neogen SC) was subsequently made, followed by heating to a temperature of 95° C. while continuing to stir and then holding for 4.5 hours. This was followed by cooling, filtration of the reaction product, thorough washing with deionized water, and then fluidized bed drying at a temperature of 45° C. to obtain toner particles. These toner particles contained 65.0 mass parts of the styrene-acrylic resin, 35.0 mass parts of the crystalline material, 5.5 mass parts of the cyan colorant, 9.0 mass parts of the wax, and 0.6 mass parts of the negative charging charge control agent.

A toner 32 was obtained by mixing 100.0 mass parts of these toner particles for 15 minutes using a HENSCHEL® mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20.0 mass % with reference to the finely divided silica particles. The properties of toner 32 are given in Table 4.

<Production of Toner 33>

The following materials were preliminarily mixed and melt-kneaded with a twin-screw extruder, and the cooled kneaded material was pulverized with a hammer mill (Hosokawa Micron Corporation) and the obtained pulverized material was classified to obtain toner particles.

binder resin 65.0 mass parts
(styrene/n-butyl acrylate copolymer
resin (Mw=30,000, Tg=50° C.))
crystalline material 1 35.0 mass parts
C. I. Pigment Blue 15:3 5.5 mass parts
metal compound of a dialkylsalicylic acid 3.0 mass parts
(Orient Chemical Industries Co., Ltd.: BONTRON E88)
hydrocarbon wax (Tm=78° C.) 6.0 mass parts A toner 33 was obtained by mixing 100.0 mass parts of the obtained toner particles for 15 minutes using a HENSCHEL® mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. The properties of toner 33 are given in Table 4.

<Production of Toner 33>

The following materials were preliminarily mixed and melt-kneaded with a twin-screw extruder, and the cooled kneaded material was pulverized with a hammer mill (Hosokawa Micron Corporation) and the obtained pulverized material was classified to obtain toner particles.

binder resin 65.0 mass parts
(styrene/n-butyl acrylate copolymer
resin (Mw=30,000, Tg=50° C.))
crystalline material 1 35.0 mass parts
C. I. Pigment Blue 15:3 5.5 mass parts
metal compound of a dialkylsalicylic acid 3.0 mass parts
(Orient Chemical Industries Co., Ltd.: BONTRON E88)
hydrocarbon wax (Tm=78° C.) 6.0 mass parts A toner 33 was obtained by mixing 100.0 mass parts of the obtained toner particles for 15 minutes using a Henschel mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. The properties of toner 33 are given in Table 4.

TABLE 4

| | binder resin | | | | | | | |
|---|---|---|---|---|---|---|---|---|
| toner NO. | crystalline resin (crystalline material NO.) | mass parts | styrene-acrylic resin | mass parts | D1 (μm) | D4 (μm) | Mw | V |
| 1 | 1 | 35.0 | styrene:n-butyl acrylate 78:22 | 65.0 | 4.8 | 5.7 | 33000 | 0.71 |
| 2 | 2 | 35.0 | styrene:n-butyl acrylate 78:22 | 65.0 | 4.8 | 5.6 | 31500 | 0.90 |
| 3 | 3 | 35.0 | styrene:n-butyl acrylate 78:22 | 65.0 | 4.8 | 5.3 | 33000 | 0.48 |
| 4 | 4 | 35.0 | styrene:n-butyl acrylate 78:22 | 65.0 | 5.2 | 5.8 | 30000 | 1.10 |
| 5 | 5 | 35.0 | styrene:n-butyl acrylate 78:22 | 65.0 | 5.0 | 5.6 | 38000 | 0.50 |
| 6 | 6 | 35.0 | styrene:n-butyl acrylate 78:22 | 65.0 | 5.1 | 5.5 | 34500 | 1.05 |
| 7 | 7 | 35.0 | styrene:n-butyl acrylate 78:22 | 65.0 | 5.2 | 5.9 | 34000 | 0.55 |
| 8 | 8 | 35.0 | styrene:n-butyl acrylate 78:22 | 65.0 | 4.8 | 5.5 | 34000 | 0.60 |
| 9 | 1 | 10.0 | styrene:n-butyl acrylate 78:22 | 90.0 | 5.2 | 5.8 | 30000 | 0.71 |
| 10 | 1 | 50.0 | styrene:n-butyl acrylate 78:22 | 50.0 | 5.0 | 5.6 | 38000 | 0.71 |
| 11 | 1 | 5.0 | styrene:n-butyl acrylate 78:22 | 95.0 | 5.1 | 5.5 | 34500 | 0.71 |
| 12 | 1 | 55.0 | styrene:n-butyl acrylate 78:22 | 45.0 | 5.2 | 5.9 | 34000 | 0.71 |
| 13 | 9 | 35.0 | styrene:n-butyl acrylate 78:22 | 65.0 | 4.8 | 5.5 | 34000 | 0.50 |
| 14 | 10 | 35.0 | styrene:n-butyl acrylate 78:22 | 65.0 | 4.9 | 5.5 | 35000 | 0.45 |
| 15 | 11 | 35.0 | styrene:n-butyl acrylate 78:22 | 65.0 | 4.8 | 5.6 | 32000 | 0.41 |
| 16 | 12 | 35.0 | styrene:n-butyl acrylate 78:22 | 65.0 | 4.7 | 5.7 | 34000 | 0.42 |
| 17 | 13 | 35.0 | styrene:n-butyl acrylate 78:22 | 65.0 | 4.8 | 5.8 | 29000 | 0.90 |
| 18 | 14 | 35.0 | styrene:n-butyl acrylate 78:22 | 65.0 | 4.9 | 6.1 | 39000 | 0.42 |
| 19 | 15 | 35.0 | styrene:n-butyl acrylate 78:22 | 65.0 | 5.0 | 5.9 | 28000 | 0.94 |
| 20 | 16 | 35.0 | styrene:n-butyl acrylate 78:22 | 65.0 | 4.7 | 6.0 | 39500 | 0.97 |
| 21 | 17 | 35.0 | styrene:n-butyl acrylate 78:22 | 65.0 | 4.6 | 5.6 | 29500 | 0.45 |
| 22 | 18 | 35.0 | styrene:n-butyl acrylate 78:22 | 65.0 | 4.7 | 5.8 | 38500 | 0.42 |
| 23 | 19 | 35.0 | styrene:n-butyl acrylate 78:22 | 65.0 | 4.9 | 5.4 | 33000 | 0.70 |
| 24 | 20 | 35.0 | styrene:n-butyl acrylate 78:22 | 65.0 | 5.0 | 6.1 | 35000 | 0.71 |
| 25 | 21 | 35.0 | styrene:isobutyl acrylate 69:31 | 65.0 | 5.1 | 5.8 | 34000 | 0.71 |
| 26 | 22 | 35.0 | styrene:propyl acrylate 74:26 | 65.0 | 4.5 | 5.9 | 33000 | 0.71 |

TABLE 4-continued

| toner NO. | binder resin: crystalline resin (crystalline material NO.) | mass parts | styrene-acrylic resin | mass parts | D1 (μm) | D4 (μm) | Mw | V |
|---|---|---|---|---|---|---|---|---|
| 27 | 1 | 35.0 | styrene:2-ethylhexyl acrylate 85:15 | 65.0 | 4.9 | 5.6 | 35000 | 0.71 |
| 28 | 1 | 35.0 | styrene:tert-butyl acrylate 28:72 | 65.0 | 4.8 | 5.7 | 33000 | 0.71 |
| 29 | 1 | 35.0 | styrene:n-butyl acrylate 80:20 | 65.0 | 4.9 | 5.9 | 35000 | 0.71 |
| 30 | 1 | 35.0 | styrene:n-butyl acrylate 80:20 | 65.0 | 4.7 | 5.7 | 34000 | 0.71 |
| 31 | 1 | 35.0 | styrene:n-butyl acrylate 75:25 | 65.0 | 5.0 | 5.8 | 36000 | 0.71 |
| 32 | 1 | 35.0 | styrene:n-butyl acrylate 78:22 | 65.0 | 4.7 | 5.6 | 32000 | 0.71 |
| 33 | 1 | 35.0 | styrene:n-butyl acrylate 78:22 | 65.0 | 4.8 | 5.4 | 33000 | 0.71 |
| 34 | 23 | 35.0 | styrene:n-butyl acrylate 78:22 | 65.0 | 4.9 | 6.0 | 34000 | 0.35 |
| 35 | 24 | 35.0 | styrene:n-butyl acrylate 78:22 | 65.0 | 4.8 | 5.5 | 35000 | 1.21 |
| 36 | 25 | 35.0 | styrene:n-butyl acrylate 78:22 | 65.0 | 4.3 | 5.9 | 32000 | 0.38 |
| 37 | 26 | 35.0 | styrene:n-butyl acrylate 78:22 | 65.0 | 4.8 | 6.1 | 55000 | 0.24 |
| 38 | 1 | 2.0 | styrene:n-butyl acrylate 78:22 | 95.0 | 5.2 | 6.2 | 34500 | 0.71 |
| 39 | 1 | 1.0 | styrene:n-butyl acrylate 78:22 | 95.0 | 5.1 | 6.0 | 35500 | 0.71 |
| 40 | 27 | 35.0 | styrene:n-butyl acrylate 78:22 | 65.0 | 4.8 | 6.0 | 36500 | 0.97 |
| 41 | 28 | 35.0 | styrene:n-butyl acrylate 78:22 | 65.0 | 4.7 | 5.8 | 33000 | 0.98 |

<The Colorant Dispersibility in the Fixed Image>

This evaluation was performed using a Satera LBP5050 commercial color laser printer (Canon, Inc.) that had been partially modified. The modifications included a conversion to enable output of the unfixed image by removing the fixing unit, and the ability to adjust the image density with a controller. Another modification enabled operation with just a single color process cartridge installed.

The toner in a commercial cartridge was extracted; the interior was cleaned with an air blower; and the test toner (30 g) and toner carrying member were subsequently installed in the cartridge.

This cartridge was installed in the printer; a 1 cm×1 cm patch image was output at 5 points on the transfer material, i.e., the upper left, the upper right, the center, the lower left, and the lower right; and adjustment was made with the controller so the toner laid-on amount for each patch was 0.30 g/m$^2$. After this, the fixing unit was installed and a fixed image of this patch image was output. The toner tinting strength was evaluated based on the image density at the five patch regions in this patch image. The image density was measured using a "MacBeth RD918 Reflection Densitometer" (MacBeth Corporation); the relative density was measured with reference to the printed out image of a white background region for which the density was 0.00; and the average value of the five patches was calculated. The evaluation criteria are given below. Letter-size HP Brochure Paper 150 g, Glossy paper (HP, 150 g/m$^2$) was used as the transfer material.

(Evaluation Criteria)

A: at least 1.30 (the colorant dispersibility of the fixed image is particularly excellent)

B: at least 1.15 but less than 1.30 (the colorant dispersibility of the fixed image is excellent)

C: at least 1.05 but less than 1.15 (the colorant dispersibility of the fixed image is unproblematic)

D: less than 1.05 (the colorant dispersibility of the fixed image is problematic from a use standpoint)

<The Low-Temperature Fixability>

A color laser printer (HP Color LaserJet 3525dn, Hewlett-Packard) from which the fixing unit had been removed was prepared; the toner was removed from the cyan cartridge; and the toner to be evaluated was filled as a replacement. Then, using the filled toner, a 2.0 cm long by 15.0 cm wide unfixed toner image (0.6 mg/cm$^2$) was formed on the image-receiving paper (Office Planner from Canon, Inc., 64 g/m$^2$) at a position 1.0 cm from the top edge considered in the paper transit direction. The removed fixing unit was modified so the fixation temperature and process speed could be adjusted and was used to conduct a fixing test on the unfixed image.

First, operating in a normal-temperature normal-humidity environment (23° C., 60% RH) at a process speed of 250 mm/s and with the fixing linear pressure set to 27.4 kgf and the initial temperature set to 100° C., the unfixed image was fixed at each temperature level while raising the set temperature sequentially in 5° C. increments.

The evaluation criteria for the low-temperature fixability are given below. The low-temperature-side fixing starting point is defined as follows: a fold in the vertical direction is made in the central region of the image and a crease is made using a load of 4.9 kPa (50 g/cm$^2$); a crease is similarly made in the direction orthogonal to the first crease; the intersection of the creases is rubbed 5 times at a speed of 0.1 m/second with lens cleaning paper (Dusper K-3) loaded with 4.9 kPa (50 g/cm$^2$); and the low-temperature-side fixing starting point is taken to be the lowest temperature at which the percentage decline in the density pre-versus-post-rubbing is 10% or less.

(Evaluation Criteria)

A: the low-temperature-side fixing starting point is equal to or less than 115° C. (the low-temperature fixability is particularly excellent)

B: the low-temperature-side fixing starting point is 120° C. or 125° C. (excellent low-temperature fixability)

C: the low-temperature-side fixing starting point is 130° C. or 135° C. (unproblematic low-temperature fixability)

D: the low-temperature-side fixing starting point is 140° C. or 145° C. (somewhat poor low-temperature fixability, problematic from a use standpoint)

E: the low-temperature-side fixing starting point is 150° C. or more (poor low-temperature fixability, problematic from a use standpoint)

<The High-Temperature Fixability>

The high-temperature fixability was also similarly evaluated using the evaluation method described above.

(Evaluation Criteria)

A: offset is not present at 210° C. (particularly excellent high-temperature fixability)

B: offset is produced at 200° C. (the high-temperature fixability is excellent)

C: offset is produced at 190° C. (unproblematic high-temperature fixability)

D: offset is produced at 180° C.

<The Gloss>

Using a PG-3D (Nippon Denshoku Industries Co., Ltd.), the 75° gloss value was measured on the solid image (toner laid-on amount: 0.6 mg/cm$^2$) provided when the fixation temperature in the aforementioned evaluation method was set to 160° C. Letter-size general-purpose paper (Xerox 4200 paper, from the Xerox Corporation, 75 g/m$^2$) was used as the transfer material.

(Evaluation Criteria)

A: the gloss value is at least 30

B: the gloss value is at least 20 but less than 30

C: the gloss value is at least 15 but less than 20

D: the gloss value is less than 15

<The Durability>

Using a color laser printer (HP Color LaserJet 3525dn, HP), 20,000 prints of a horizontal line image with a 1% print percentage were made in a print-out test in a normal-temperature normal-humidity environment (23° C. temperature/60% RH humidity:NN) and in a high-temperature high-humidity environment (33° C. temperature/85% RH humidity:HH). After completion of the print-out test, a halftone (toner laid-on amount: 0.6 mg/cm$^2$) image was printed out on letter-size Xerox 4200 paper (Xerox Corporation, 75 g/m$^2$) and an evaluation of the development stripes was performed. Development stripes are more easily produced at lower durabilities.

(Evaluation Criteria)

A: not produced

B: a development stripe is produced at from 1 location to not more than 3 locations C: a development stripe is produced at from 4 locations to not more than 6 locations D: a development stripe is produced at 7 or more locations, or is produced with a width of at least 0.5 mm <The Heat-Resistant Storability>

5 g of the particular toner was placed in a 50-cc plastic cup and was held for 3 days at a temperature of 50° C./humidity of 10% RH, and the evaluation was then performed by checking for the presence/absence of aggregate lumps.

(Evaluation Criteria)

A: no aggregate lumps are produced (particularly excellent heat-resistant storability)

B: minor aggregate lumps are produced and are collapsed by light shaking (excellent heat-resistant storability)

C: minor aggregate lumps are produced and are collapsed by light finger pressure (no problem for the heat-resistant storability)

D: aggregate lumps are produced, but are not collapsed even by light finger pressure (poor heat-resistant storability, problematic from a use standpoint)

Examples 1 to 37

The evaluations described above were carried out in Examples 1 to 37 using each of the toners 1 to 33 and 38 to 41 as the toner. The results of these evaluations are given in Table 5.

Comparative Examples 1 to 4

The evaluations described above were carried out in Comparative Examples 1 to 4 using each of the toners to 37 as the toner. The results of these evaluations are given in Table 5.

TABLE 5

| | toner | colorant | heat-resistant | low-temperature | high-temperature | | durability | |
|---|---|---|---|---|---|---|---|---|
| | NO. | dispersibility | storability | fixability | fixability | gloss | NN | HH |
| Example1 | 1 | A | A | A(110° C.) | A | A(31) | A(0) | A(0) |
| Example2 | 2 | A | A | A(110° C.) | A | A(33) | A(0) | A(0) |
| Example3 | 3 | B | A | A(115° C.) | A | A(30) | A(0) | A(0) |
| Example4 | 4 | A | C | A(110° C.) | B | A(35) | B(2) | B(3) |
| Example5 | 5 | A | A | B(120° C.) | A | A(30) | A(0) | A(0) |
| Example6 | 6 | A | C | A(110° C.) | A | A(34) | A(0) | B(1) |
| Example7 | 7 | A | A | C(130° C.) | A | A(31) | B(1) | B(1) |
| Example8 | 8 | A | A | C(130° C.) | A | B(28) | B(1) | B(1) |
| Example9 | 9 | A | A | B(120° C.) | A | A(30) | A(0) | A(0) |
| Example10 | 10 | A | B | A(110° C.) | A | A(30) | A(0) | B(1) |
| Example11 | 11 | A | A | C(130° C.) | A | B(27) | A(0) | A(0) |
| Example12 | 12 | A | B | A(110° C.) | A | A(31) | B(1) | C(5) |
| Example13 | 13 | A | A | B(120° C.) | A | B(26) | A(0) | A(0) |
| Example14 | 14 | B | B | A(115° C.) | A | A(30) | A(0) | A(0) |
| Example15 | 15 | B | A | C(130° C.) | A | B(22) | A(0) | A(0) |
| Example16 | 16 | B | C | A(115° C.) | A | A(30) | A(0) | B(1) |
| Example17 | 17 | A | B | A(110° C.) | A | A(33) | A(0) | B(3) |
| Example18 | 18 | B | A | B(120° C.) | A | B(27) | A(0) | B(1) |
| Example19 | 19 | A | C | A(110° C.) | A | A(35) | B(1) | B(2) |
| Example20 | 20 | A | C | A(110° C.) | B | A(31) | B(1) | B(1) |
| Example21 | 21 | C | A | C(130° C.) | A | B(25) | A(0) | B(2) |
| Example22 | 22 | C | A | C(130° C.) | B | B(28) | B(1) | B(2) |
| Example23 | 23 | A | A | A(110° C.) | B | A(30) | A(0) | A(0) |
| Example24 | 24 | A | A | A(110° C.) | A | B(22) | A(0) | B(2) |
| Example25 | 25 | A | A | A(110° C.) | C | A(31) | A(0) | A(0) |
| Example26 | 26 | A | A | A(110° C.) | A | C(17) | B(1) | C(5) |
| Example27 | 27 | A | A | A(110° C.) | A | A(30) | A(0) | A(0) |
| Example28 | 28 | A | A | A(110° C.) | A | A(31) | A(0) | A(0) |

TABLE 5-continued

| | toner NO. | colorant dispersibility | heat-resistant storability | low-temperature fixability | high-temperature fixability | gloss | durability NN | durability HH |
|---|---|---|---|---|---|---|---|---|
| Example29 | 29 | A | C | A(110° C.) | A | A(31) | B(2) | C(6) |
| Example30 | 30 | A | A | C(130° C.) | A | A(30) | A(0) | A(0) |
| Example31 | 31 | A | A | A(110° C.) | A | A(32) | A(0) | B(2) |
| Example32 | 32 | A | A | A(110° C.) | A | A(30) | A(0) | B(2) |
| Example33 | 33 | A | B | A(110° C.) | A | A(31) | A(0) | B(2) |
| Example34 | 38 | A | A | C(130° C.) | A | B(26) | A(0) | A(0) |
| Example35 | 39 | A | A | C(135° C.) | A | B(26) | A(0) | A(0) |
| Example36 | 40 | A | C | A(110° C.) | B | A(31) | B(1) | B(1) |
| Example37 | 41 | A | C | A(110° C.) | B | A(31) | B(2) | B(3) |
| Comparative Example1 | 34 | D | A | D(140° C.) | A | D(14) | A(0) | A(0) |
| Comparative Example2 | 35 | A | D | A(110° C.) | A | A(37) | C(4) | D(10) |
| Comparative Example3 | 36 | D | A | C(130° C.) | C | C(18) | A(0) | A(0) |
| Comparative Example4 | 37 | D | D | D(140° C.) | C | C(16) | C(4) | C(6) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247690, filed Nov. 29, 2013, and which is hereby incorporated by reference herein in its entirety.

What is claimed is:

1. A toner comprising:

a toner particle that contains a colorant, and a binder resin containing a styrene-acrylic resin and a crystalline resin, wherein a compatibility parameter (V) between the styrene-acrylic resin and the crystalline resin satisfies $0.40 \leq V \leq 1.10$, and a weight-average molecular weight (Mw) of the crystalline resin is 15,000 to 45,000.

2. The toner according to claim 1, wherein the crystalline resin is a block polymer having a polyester segment and a vinyl polymer segment, and the polyester segment has a structure represented by formula (1) and a structure represented by formula (2):

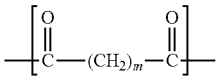

(1)

where m represents an integer from 6 to 14)

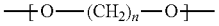

(2)

where n represents an integer from 6 to 16).

3. The toner according to claim 2, wherein a mass ratio between the polyester segment and the vinyl polymer segment is from 40:60 to 80:20.

4. The toner according to claim 3, wherein the mass ratio between the polyester segment and the vinyl polymer segment is from 40:60 to 70:30.

5. The toner according to claim 2, wherein a ratio (Mw/Mn) of a weight-average molecular weight (Mw) of the vinyl polymer segment to a number-average molecular weight (Mn) of the vinyl polymer segment is from 1.5 to 3.5.

6. The toner according to claim 2, wherein a weight-average molecular weight (Mw) of the vinyl polymer segment is from 4,000 to 15,000.

7. The toner according to claim 1, wherein a melting point of the crystalline resin is from 55 to 90° C.

8. The toner according to claim 1, wherein a content of the crystalline resin in the binder resin is from 2.0 to 50.0 mass %.

9. The toner according to claim 8, wherein the content of the crystalline resin in the binder resin is from 6.0 to 50.0 mass %.

10. The toner according to claim 1, wherein the weight-average molecular weight (Mw) of the crystalline resin is from 20,000 to 45,000.

11. The toner according to claim 1, wherein a ratio (Mw/Mn) of a weight-average molecular weight (Mw) of the crystalline resin to a number-average molecular weight (Mn) of the crystalline resin is from 1.5 to 3.5.

12. The toner according to claim 1, wherein the toner particle is a toner particle that is produced by a suspension polymerization method.

* * * * *